US008596207B2

(12) United States Patent
Dubois et al.

(10) Patent No.: US 8,596,207 B2
(45) Date of Patent: Dec. 3, 2013

(54) FLAT PALLET

(75) Inventors: Jean-Marc Dubois, Bremgarten (CH); Douwe Hoekstra, Muri (CH); Marco Marti, Bremgarten (CH)

(73) Assignee: Georg Utz Holding AG, Bremgarten (CH)

( * ) Notice: Subject to any disclaimer, the term of this patent is extended or adjusted under 35 U.S.C. 154(b) by 394 days.

(21) Appl. No.: 12/328,959

(22) Filed: Dec. 5, 2008

(65) Prior Publication Data

US 2009/0145339 A1 Jun. 11, 2009

(30) Foreign Application Priority Data

Dec. 6, 2007 (CH) ..... 01885/07

(51) Int. Cl.
*B65D 19/38* (2006.01)

(52) U.S. Cl.
USPC ..... 108/57.26; 108/91; 108/53.1

(58) Field of Classification Search
USPC ..... 108/56.1, 57.29, 901, 57.25, 57.26, 108/57.27, 91, 53.1; 52/177, 592.1; 248/346.02, 678
See application file for complete search history.

(56) References Cited

U.S. PATENT DOCUMENTS

| | | | | | |
|---|---|---|---|---|---|
| 2,740,167 | A | * | 4/1956 | Rowley | 52/591.1 |
| 3,043,407 | A | * | 7/1962 | Marryatt | 52/588.1 |
| 3,650,224 | A | | 3/1972 | Petix et al. | |
| 3,699,901 | A | | 10/1972 | Cook, III | |
| 3,909,996 | A | * | 10/1975 | Ettlinger, Jr. et al. | 52/177 |
| 4,580,680 | A | * | 4/1986 | Wind | 206/386 |
| 4,807,412 | A | * | 2/1989 | Frederiksen | 52/177 |
| 4,890,743 | A | * | 1/1990 | Powel et al. | 206/595 |
| 4,917,532 | A | * | 4/1990 | Haberhauer et al. | 404/35 |
| 5,007,352 | A | * | 4/1991 | Calkoen | 108/56.1 |
| 5,263,668 | A | * | 11/1993 | Reiter | 248/346.01 |
| 5,860,369 | A | * | 1/1999 | John et al. | 108/57.26 |
| 5,950,378 | A | * | 9/1999 | Council et al. | 52/177 |
| 6,234,087 | B1 | * | 5/2001 | Brown | 108/56.1 |
| 6,659,019 | B2 | * | 12/2003 | Gruber et al. | 108/53.5 |
| 6,694,672 | B1 | * | 2/2004 | Hergeth | 47/65.9 |
| 6,928,933 | B2 | * | 8/2005 | Grau | 108/57.25 |
| 2006/0242901 | A1 | * | 11/2006 | Casimaty et al. | 47/65.9 |
| 2006/0288651 | A1 | * | 12/2006 | Zeng et al. | 52/177 |
| 2007/0094979 | A1 | * | 5/2007 | Richardson et al. | 52/578 |
| 2007/0283658 | A1 | * | 12/2007 | Siewert et al. | 52/590.2 |
| 2009/0139160 | A1 | * | 6/2009 | Hill | 52/177 |

FOREIGN PATENT DOCUMENTS

| | | |
|---|---|---|
| EP | 1 419 973 A1 | 5/2004 |
| WO | WO 92/01607 | 2/1992 |
| WO | WO 98/31595 | 7/1998 |
| WO | WO 2007/124530 | 11/2007 |

* cited by examiner

*Primary Examiner* — Darnell Jayne
*Assistant Examiner* — Andres F Gallego
(74) *Attorney, Agent, or Firm* — Henry M. Feiereisen LLC

(57) ABSTRACT

A flat pallet for handling and storing articles includes two identical boards. Each board has at least one length side which is provided with a coupling mechanism. The coupling mechanism includes a grip element and a receiving element of a configuration complementing the grip element. The grip element is spaced from a first transverse side of the board by a distance which corresponds to a distance of the receiving element from a second transverse side of the board, wherein the grip element of one board is constructed for engagement in the receiving element of the other board.

12 Claims, 3 Drawing Sheets

FLAT PALLET

CROSS-REFERENCES TO RELATED APPLICATIONS

This application claims the priority of Swiss Patent Application, Serial No. 01885/07, filed Dec. 6, 2007, pursuant to 35 U.S.C. 119(a)-(d), the content of which is incorporated herein by reference in its entirety as if fully set forth herein.

BACKGROUND OF THE INVENTION

The present invention relates, in general, to a flat pallet as carrier for handling and storage of articles.

Nothing in the following discussion of the state of the art is to be construed as an admission of prior art.

Various storage concepts are used to store unit loads, hereinafter referred to as articles. For example, articles are shipped on throw-away pallets or other packaging materials and transferred onto flat pallets. The loaded flat pallets are then transported via conveyors to a storage site and placed there. When being shipped, the articles on the flat pallets are transferred to a transfer station where the articles are removed by hand from the flat pallet. Manual loading or unloading of pallets is a strenuous exercise and labor-intensive, in particular when Industrial pallets are involved which have dimensions of about 1 m×1.2 m, because the articles must be lifted or deposited from or onto the pallet across a distance of up to more than a meter. This is unacceptable for personnel, especially when the articles are large and heavy.

It would therefore be desirable and advantageous to provide an improved flat pallet to address these problems and to obviate other prior art shortcomings.

SUMMARY OF THE INVENTION

According to one aspect of the present invention, a flat pallet includes two identical boards, each board having at least one length side provided with a coupling mechanism which includes a grip element and a receiving element of a configuration complementing the grip element, wherein the grip element is spaced from a first transverse side of the board by a distance which corresponds to a distance of the receiving element from a second transverse side of the board, wherein the grip element of one board is constructed for engagement in the receiving element of the other board.

A flat pallet according to the present invention is easy to load and to unload and the boards of the flat pallets are easy to handle. As it is comprised of identical boards, the flat pallet is easy to make and manufacturing costs can be saved.

According to another feature of the present invention, the coupling mechanism of each board may have two grip elements and two receiving elements along the length side to effect a hinged connection between the grip elements of one board and the receiving elements of the other board.

According to another feature of the present invention, the boards, when assembled via the complementing grip and receiving elements to assume a side-by-side disposition, define along the length side an axis, wherein the boards are swingable about the axis by an angle of greater than 25° for coupling and uncoupling the boards.

According to another feature of the present invention, each board may have a bottom side formed with ribs to increase stability, with the ribs being spaced from one another by a distance of maximal 60 mm.

According to another feature of the present invention, each board may have a bottom side formed with two channels for receiving a steel pipe.

According to another feature of the present invention, each board may have a topside provided with at least two knobs and a bottom side formed with a ribbing configured to include pockets so that the knobs of one board can engage in the pockets of the other board, when the two boards are stacked.

According to another feature of the present invention, each board may have a bottom side formed with a ribbing configured to include a recess in the first and second transverse sides of the board to form a grip with the topside of the board.

According to another feature of the present invention, each board may have a topside provided with at least one opening to form a gripping hole.

According to another aspect of the present invention, a method of making a flat pallet includes the steps of placing a first board on a loading site, loading the first board, attaching a side of a second board to a side of the first board to produce the finished flat pallet, and loading the second board.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
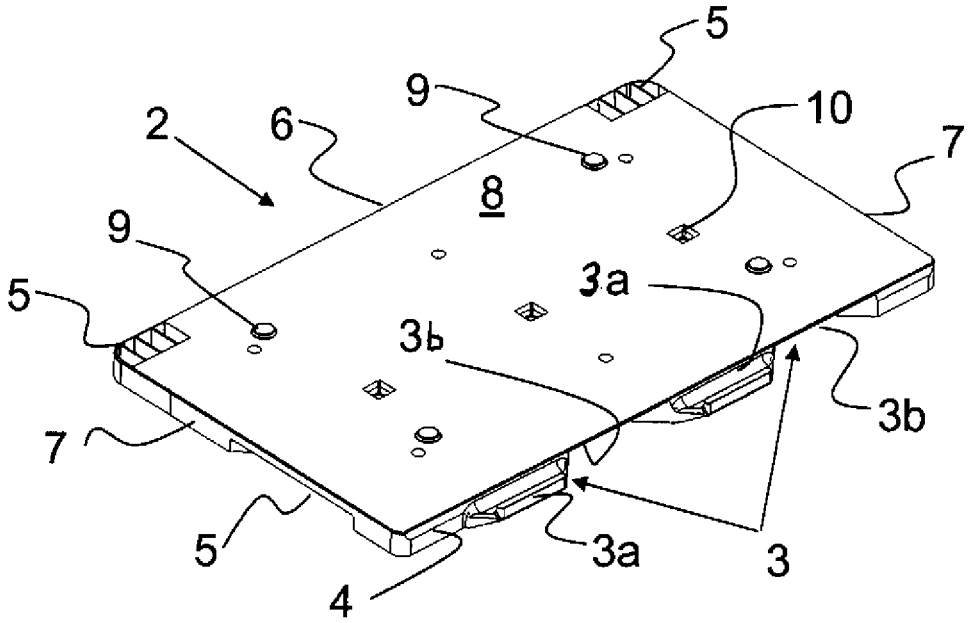
FIG. 1 is a top and side perspective view of a board for a flat pallet in accordance with the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 2:
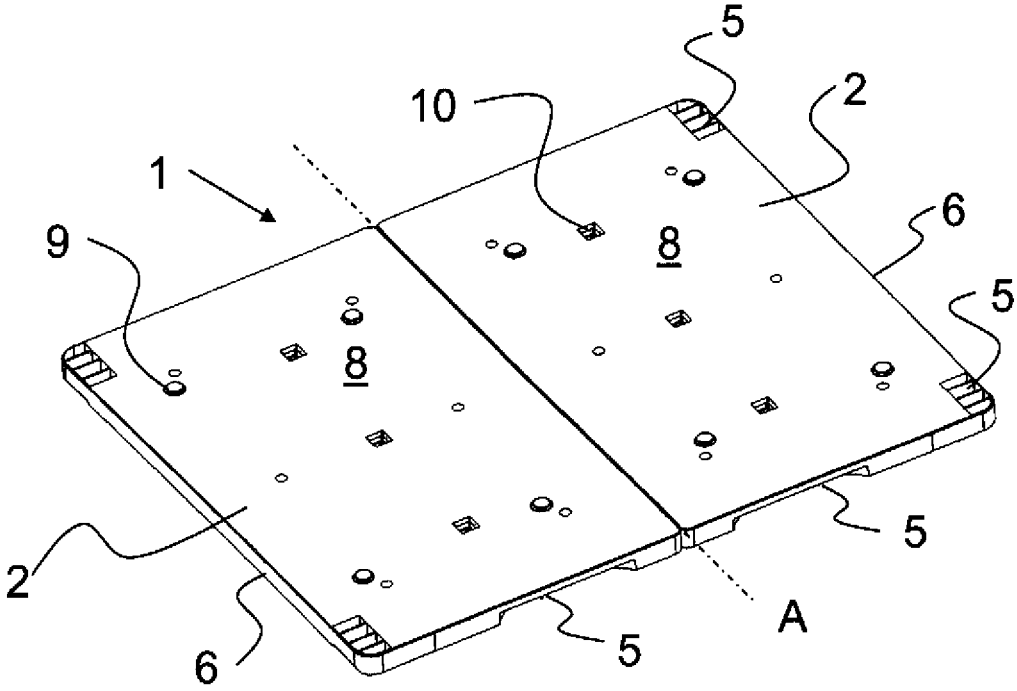
FIG. 2 is a top and side perspective view of two interconnected boards to form a two-part flat pallet in accordance with the present invention.

Turning now to the drawing, and in particular to FIG. 1, there is shown a top and side perspective view of a single board, generally designated by reference numeral 2, for use in the formation of a flat pallet according to the present invention, generally designated by reference numeral 1 and shown in FIG. 2 in the form of a two-part flat pallet. In the non-limiting example shown here, the flat pallet 2 is made of two identical boards 1 which are interconnected by a coupling mechanism, generally designated by reference numeral 3. As shown in FIG. 1, the board 2 has a rectangular shape with substantially planar topside 8 and defines two transverse sides 7 and two length sides 4, 6. The board 2 has slightly rounded corners and has dimensions of 1016 mm×610 mm and a thickness of 40 mm. Currently preferred is the manufacture of the board 2 from HDPE (high density polyethylene) plastic. The board 2 has a bottom side which is formed with ribs 12 (FIG. 5) and reinforced with steel tubes (not shown) to enhance the overall stability. The coupling mechanism 3 is provided along at least one length side (here length side 4 for example) of the board 2 and includes at least one grip element 3*a* and at least one grip receiving element 3*b* next to the grip element 3*a*. By way of example, the board 2 shown in FIG. 1 has two grip elements 3*a* and two receiving elements 3*b* along the length side 4 in alternating sequence. The grip element 3*a* is hereby spaced from the adjacent transverse side 7 by a distance which corresponds to a distance of the receiving element 3*b* from the other transverse side 7 of the board 2.

When assembling the flat pallet 1 from two such boards 2, as shown in FIG. 2, one of the boards 2 is turned by 180° in relation to the other board 2 so that the coupling mechanism of both boards 2 confront one another, with a grip element 3*a* of one board 2 positioned exactly in opposition to a receiving element 3*b* of the other board 2. The shape of the receiving elements 3*b* complements a shape of the grip elements 3*a* so that the grip elements 3*a* can be inserted by precision fit in the receiving elements 3*b*.

In the illustrated example, the grip elements 3*a* and the receiving elements 3*b* are configured in the form of a trapezoid. Of course, other configurations of the coupling mechanism 3 are conceivable as well.

Recesses 5 are provided in the ribbing 12 at the ends of the opposing length side 6 and in midsection of the transverse sides 7 to serve as grips. As shown for example in FIGS. 1-3, the topside 8 of the board 2 has button-like knobs 9 which engage in pockets 11 (FIG. 5) in the bottom side of a stacked board 2, when the boards 2 are being stacked. In this way, shift of stacked boards 2 is avoided. The pockets 11 may, of course, also be formed by the grid layout of the ribbing 12. In midsection, the board 2 has openings 10 to serve as gripping holes for a displacement of the boards 2 by a machine. For example, a robot may grab the boards 2 in the gripping holes 10 to stack them or to transfer them to a cleaning facility.

As shown in FIG. 2, the boards 2 extend side-by-side along their length sides 4, with the coupling mechanisms 3 confronting each other, i.e. the grip elements 3*a* and the complementary receiving elements 3*b* engage to hold the boards 2 together. In other words, the grip elements 3*a* of one board 2 engage the receiving elements 3*b* of the other board 2, and the receiving elements 3*b* of the one board 2 engage the grip elements 3*a* of the other board 2. As a result, the boards 2 are held together in the form of a hinge. Swinging one of the boards 2 upwards by an angle of >25° about the common pivot axis A, which extends along the length side 4, enables an uncoupling of both boards 2. Likewise, the two boards 2 can be coupled by bringing the two length sides 4 with the coupling mechanisms together and by swinging both boards 2 at an angle of >25°. As soon as the pivot angle is decreased, the grip elements 3*a* hook into the receiving elements 3*b* of the opposite board 2 so that the two boards 2 are hingedly connected in a detachable manner. This type of hinged connection is also beneficial when the flat pallet 1 is to be transported along a conveyor, because the flat pallet 1 is able to compensate transitions between various slopes along the conveyor path.

Figure 3:
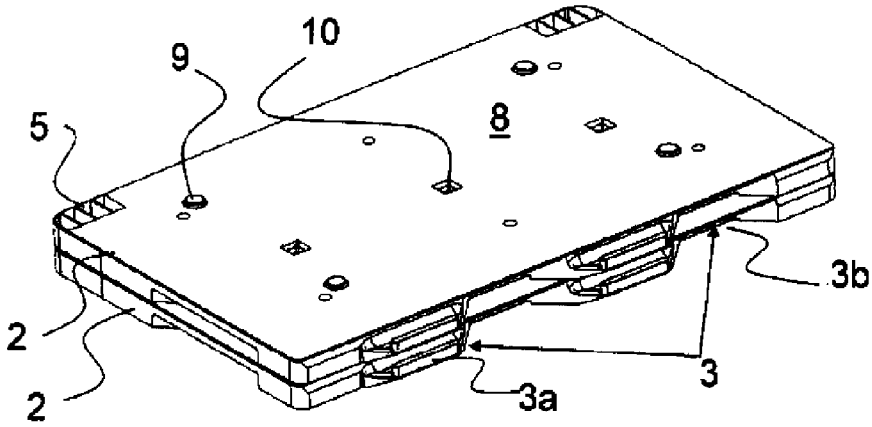
FIG. 3 is a top and side perspective view of two boards stacked on top of one another.

FIG. 3 shows the two boards 2 in stacked disposition. As a result of the knobs 9, the stacked boards 2 cannot shift and are centered so that the boards 2 lie precisely on top of one another and thus can be easily stacked.

Figure 4:
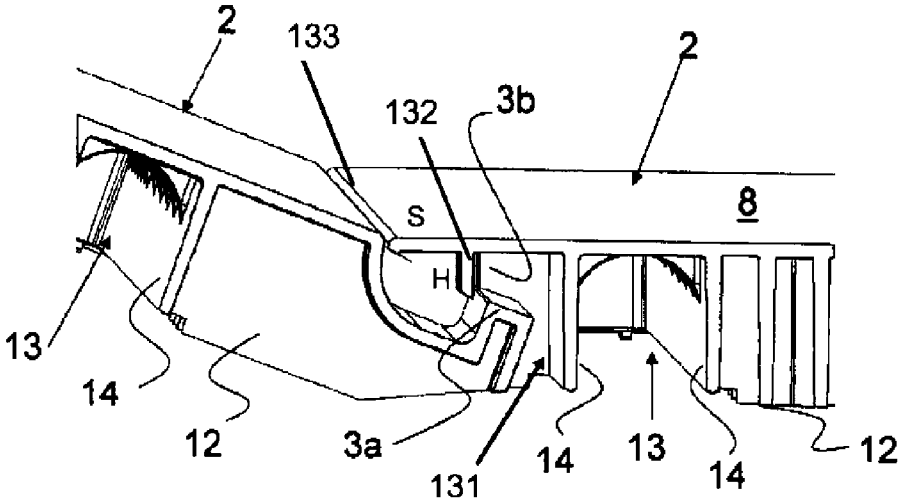
FIG. 4 is a cutaway view, on an enlarged scale, to show a coupling area between two boards of the flat pallet.

FIG. 4 is a cutaway view, on an enlarged scale, to show the coupling area between the two boards 2 of the flat pallet 1, with the boards 2 being broken open to depict internal parts. As can be seen from FIG. 4, the grip element 3*a* of the board 2 on the left-hand side is about to be engaged in the receiving element 3*b* of the board 2 on the light-hand side. The receiving element 3*b* has a groove 131 with a length-side-proximal rib 132. wherein the length-side-proximal rib 132 has a height H and is oriented parallel to and spaced from an edge of the proximate length side 133 by a distance S. The grip element 3*a* acts hereby as a hook for engagement in the receiving element 3*b* which is formed by a groove in the ribbing 12 on the bottom side of the boards 2 in parallel relationship to the length side 4. The left board 2 is slightly tilted upwards so that the grip element 3*a* has not, as of yet, fully engaged the receiving element 3*b*. As the left board 2 is lowered, the grip element 3*a* moves upwards and engages in the receiving element 3*b*. As a result of the conical or trapezoidal shape of the complementing grip and receiving elements 3*a*, 3*b*, the boards 2 center as soon as they extend substantially in a same plane. The confronting length sides 4 of the boards 2 closely abut hereby one another so that the boards 2 can be pivoted in vertical direction but are prevented from rotating in a horizontal plane. Thus, the boards 2 form with the hinged connection of the grip elements 3*a* and the associated receiving elements 3*b* a two part flat pallet 1. FIG. 4 further shows the presence of a channel 13 which extends in parallel relationship to the length side 4 and provided for receiving a tube, such as, e.g., a steel tube. The steel tube, which is not shown in FIG. 4, reinforces the board 2 and increases the load-bearing capability. When the flat pallet 1 has been assembled and includes the steel tube, the channel 13 is covered by a panel and the panel is welded to the flanks 14 of the channel 13, whereby the flanks 14 and the neighboring ribs of the ribbing 12 are made slightly shorter than the remaining ribbing 12 to accommodate for the welding operation. The bottom side of each board 2 is formed with two such channels 13 for receiving respective steel tubes.

Figure 5:
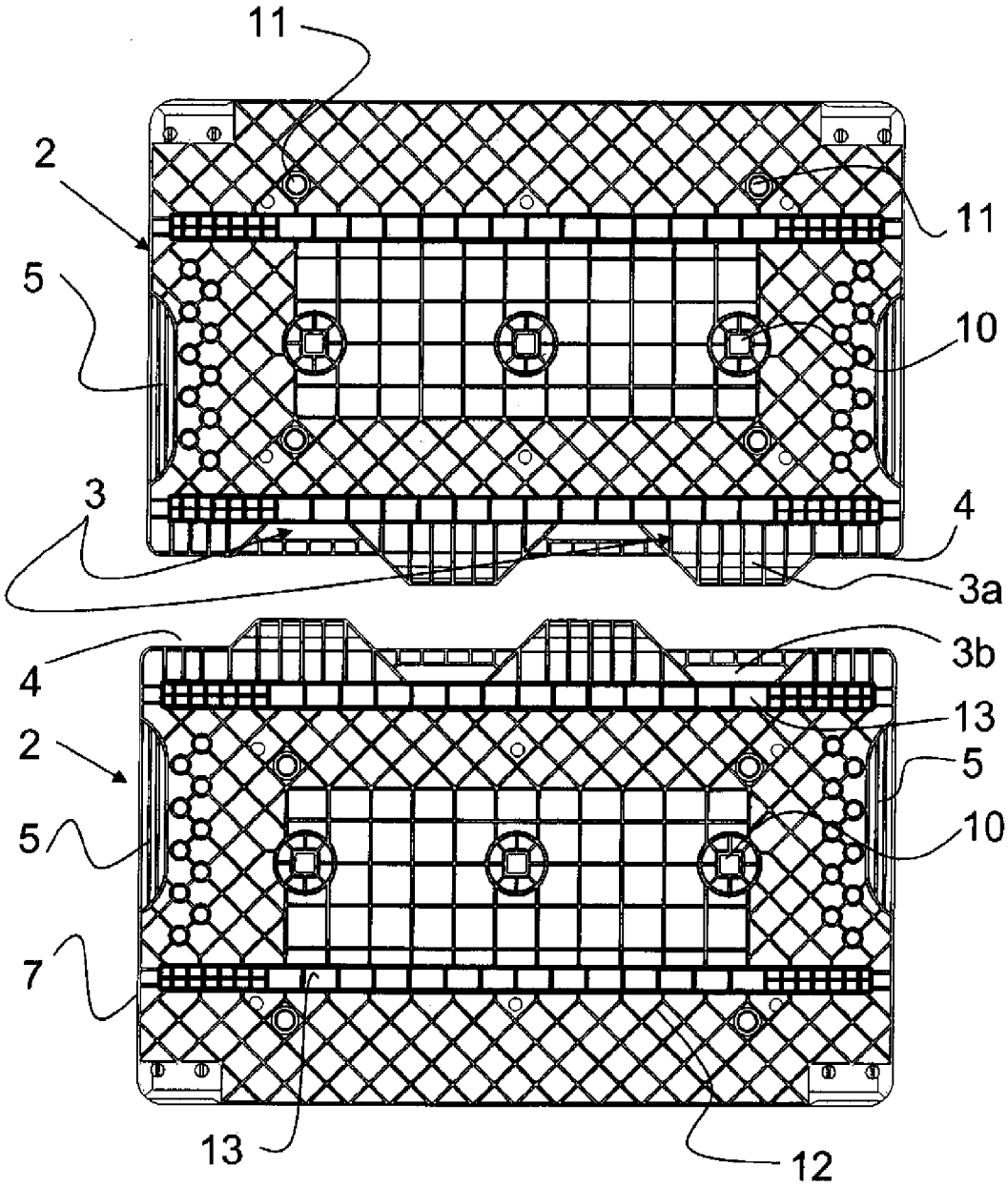
FIG. 5 is a bottom view of two boards of the pallet in side-by-side disposition.

The confronting grip and receiving elements 3*a*, 3*b* of the coupling mechanisms 3 between two boards 2 are again shown in FIG. 5 which is a bottom view of two boards 2 of the flat pallet 1 in side-by-side disposition. The bottom side of the boards 2 is ribbed to provide the boards with the required stability. Each board 2 is formed with the two channels 13 for receiving the steel tubes to further enhance stability and reinforcement of the board 2. The round pockets 11 in the ribbing 12 assist in the precise stacking of the boards 2 by receiving the knobs 10 as one board 2 is stacked on top of another board 2. The recesses 5 along the transverse sides 7 of the boards form the grips for easy handling of the boards 2. FIG. 5 also shows the presence of the gripping holes 10 on the bottom side of each board 2.

When loading a flap pallet 1 according to the present invention, one board 2 is first placed at the loading station onto the conveyor and then loaded. Then, a further board 2 is hooked onto the one board 2 laying on the conveyor via the coupling mechanism 3 and loaded. Unloading of the flat pallet 1 is executed in reverse sequence, i.e. the front board 2 is unloaded and then tilted upwards for detachment from the rear board 2 and removed from the conveyor. Next, the rear board 2 is unloaded. As a result of the slight width of the boards 2, compared to an industrial pallet, loading and unloading is greatly simplified. As in case of a two-part flat pallet, the individual boards 2 constitute only half of the flat pallet 1, its weight is thus also only half so that handling is significantly simplified and requires less force.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A flat pallet, comprising identical first and second boards, each board having a bottom side formed with two channels for receiving a steel pipe, each board having at least one length side provided with an identical hingeable coupling mechanism comprising at least one gripping element and at least one adjacent receiving element, wherein the at least one gripping element disposed on the first board engages the at least one receiving element disposed on the second board and the at least one gripping element disposed on the second board engages the at least one receiving element disposed on the first board, when the boards are interlocked, wherein at least one gripping element is constructed as a hook projecting from an edge of the first and second boards and oriented parallel to the at least one length side, and the at least one receiving element is formed by a groove with a length-side-proximal rib, said length-side-proximal rib having a height and being oriented parallel to and spaced from an edge of the at least one length side, wherein the hook is constructed so that in closely abutting relationship of the first and second boards, when an edge of the first board is substantially collinear with an edge of the second board, the hook of each board engages behind the length-side proximal rib of the other board when the boards are pivoted with respect to each other at an angle less than a predetermined angle, with the predetermined angle defined by the height of the length-side proximal rib and a spacing of the length-side proximal rib from the edge, so as to interlock the two boards, and the hook of each board disengages from the length-side proximal rib when the boards are pivoted with respect to each other at an angle greater than the predetermined angle, thereby allowing the first and second board to be decoupled in a direction perpendicular to the at least one length side.

2. The flat pallet of claim 1, wherein the bottom side of each board is formed with ribs to increase stability, said ribs being spaced from one another by a distance of maximal 60 mm.

3. The flat pallet of claim 1, wherein each board has a topside provided with at least two knobs and a bottom side formed with a ribbing configured to include pockets so that the knobs of one board engage in the pockets of the other board in one-to-one correspondence, when the two boards are stacked.

4. The flat pallet of claim 1, wherein the bottom side of each board is before "formed with a ribbing "formed with a ribbing configured to include a recess oriented in a direction of first and second transverse sides of the board to form a grip with a topside of the board.

5. The flat pallet of claim 1, wherein each board has a topside provided with at least one opening to form a gripping hole.

6. The flat pallet of claim 1, wherein each board has two gripping elements and two receiving elements.

7. A flat pallet, comprising identical first and second boards, each board having at least one length side provided with an identical hingeable coupling mechanism comprising at least one gripping element and at least one adjacent receiving element, wherein the at least one gripping element disposed on the first board engages the at least one receiving element disposed on the second board and the at least one gripping element disposed on the second board engages the at least one receiving element disposed on the first board, when the boards are interlocked, wherein each of the at least one gripping element is constructed as a hook projecting from an edge of the first and second boards and oriented parallel to the at least one length side, and each of the at least one receiving element is formed by a groove with a length-side-proximal rib, said length-side-proximal rib having a height and being oriented parallel to and spaced from an edge of the at least one length side, wherein the hook is constructed so that in closely abutting relationship of the first and second boards, when an edge of the first board is substantially collinear with an edge of the second board, the hook of each board engages behind the length-side proximal rib of the other board when the boards are pivoted with respect to each other at an angle less than a predetermined angle, with the predetermined angle defined by the height of the length-side proximal rib and a spacing of the length-side proximal rib from the edge, so as to interlock the two boards, and the hook of each board disengages from the length-side proximal rib when the boards are pivoted with respect to each other at an angle greater than the predetermined angle, thereby allowing the first and second board to be decoupled in a direction perpendicular to the at least one length side, wherein each of the at least one gripping element has a trapezoidal shape aiding centering of the two boards during coupling.

8. The flat pallet of claim 7, wherein each board has two gripping elements and two receiving elements.

9. The flat pallet of claim 7, wherein each board has a bottom side formed with ribs to increase stability, said ribs being spaced from one another by a distance of maximal 60 mm.

10. The flat pallet of claim 7, wherein each board has a topside provided with at least two knobs and a bottom side formed with a ribbing configured to include pockets so that the knobs of one board engage in the pockets of the other board in one-to-one correspondence, when the two boards are stacked.

11. The flat pallet of claim 7, wherein each board has a bottom side formed with a ribbing configured to include a recess oriented in a direction of first and second transverse sides of the board to form a grip with a topside of the board.

12. The flat pallet of claim 7, wherein each board has a topside provided with at least one opening to form a gripping hole.

* * * * *